US005165724A

United States Patent [19]

Weber

[11] Patent Number: 5,165,724

[45] Date of Patent: Nov. 24, 1992

[54] EXPANDABLE INFORMATION BINDER

[76] Inventor: Frederick E. Weber, 18 Myers Pl., Middlesex, N.J. 08846

[21] Appl. No.: 699,139

[22] Filed: May 13, 1991

[51] Int. Cl.[5] ..... B42D 3/00

[52] U.S. Cl. ..... 281/45; 281/15.1

[58] Field of Search ..... 281/45, 49, 50, 15.1, 281/21.1; 402/70

[56] References Cited

U.S. PATENT DOCUMENTS 2,918,066 12/1959 Carlson ..... 281/49

3,663,041 5/1972 White ..... 281/49 X 4,974,983 12/1990 Givati ..... 281/45 X

*Primary Examiner*—P. W. Echols

*Assistant Examiner*—Willmon Fridie, Jr.

*Attorney, Agent, or Firm*—Abdallah & Muckelroy

[57] ABSTRACT

An information binder provides secure attachment of pages in an expandable binder. The information binder has a top cover, a bottom cover and a rigid spine portion. A plurality of V-shaped members are attached to the rigid spine portion and selectively receive information pages in sealing engagement.

4 Claims, 2 Drawing Sheets

EXPANDABLE INFORMATION BINDER

BACKGROUND OF THE INVENTION

The present invention generally relates to new and useful improvements in binders for printed matter and the like. More specifically, the present invention relates to binders having durable, secure and expandable means to collect and store important information.

Important information, such as birth certificates, medical information, identifying photographs and descriptions, are often needed on short notice. Such information is usually stored loosely and/or in several places and cannot be found when needed. Various ring binders and the like are known in the prior art. Binders which can be expanded generally do not provide means for secure attachment of supplemental pages. Binders having means for secure attachment of pages generally cannot be expanded and require that all pages that are to be included in the binder be sealed or otherwise bound at one time. In the former type of binders information may be lost or removed without authorization. In the latter type of binders important information cannot be secured until a sufficient number of pages are accumulated and thus may become lost or damaged in the interim.

Thus there remains a need within the art for an expandable information binder having means for secure attachment of pages and which can be readily accessed in an emergency.

SUMMARY OF THE INVENTION

The present invention is an expandable information binder having a top cover and a bottom cover which are hingedly attached to a rigid spine portion. A plurality of vertically-extending page securing means are fixedly attached along the wide of the spine portion between the top cover and the bottom cover. The page securing means permit selective and respective receipt and secure attachment of a plurality of information pages. Each information page preferably comprises a flat stiffener enclosed in a transparent film having one side thereof open. An information page attaches at the open side thereof to a page securing means in sealing engagement to thereby provide an information page securely closed on all sides.

An object of the present invention is to provide a durable and attractive information binder that can be stored where it is readily accessible in case of an emergency.

Another object of the present invention is to provide an expandable binder having means for secure attachment of information pages.

A further object of this invention is to provide an information binder having variably configured information pages for receipt of documents, photographs etc. of varying sizes.

These and other objects and advantages of the present invention will be apparent to those skilled in the art from the following description of a preferred embodiment, claims and appended drawings.

DESCRIPTION OF PREFERRED EMBODIMENT

Figure 1:
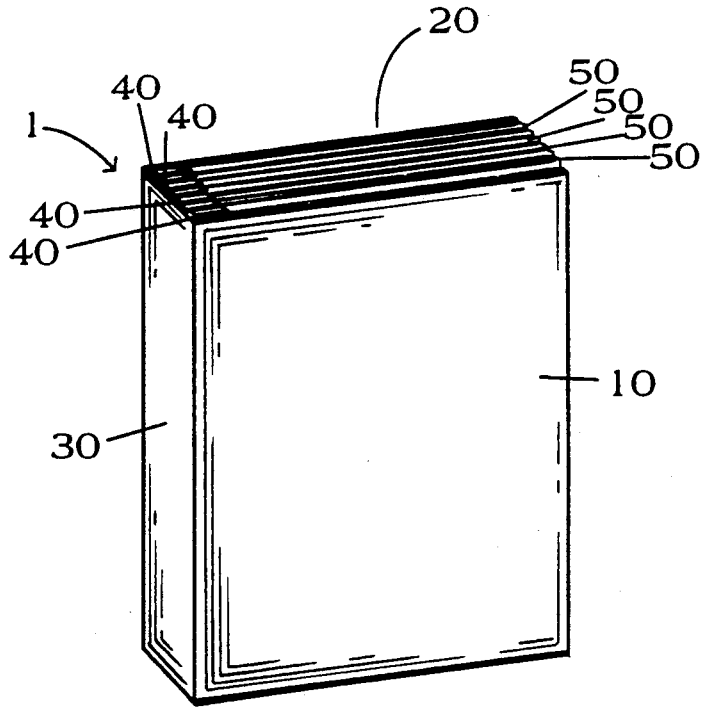
FIG. 1 is a top perspective view of the information binder of the present invention shown in a closed position.
Figure 2:
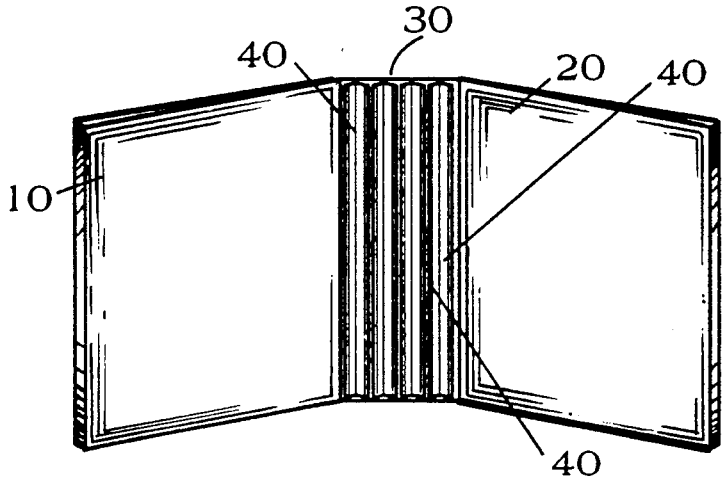
FIG. 2 is a front elevational view of the information binder shown without information pages attached thereto.

FIG. 1 illustrates in a top perspective view the information binder 1 of the present invention shown in a closed position. Information binder 1 includes a top cover 10 and a bottom cover 20 hingedly attached to and preferably integrally formed with respective sides of a spine portion 30. A plurality of page securing means 40 are fixedly attached to the spine portion 30 and a plurality of information pages 50 are attached to the respective page securing means 40. The page securing means 40 are vertically-extending members that are attached along the width of the spine portion 30 between the top cover 10 and the bottom cover 20 (FIG. 2).

Figure 3:
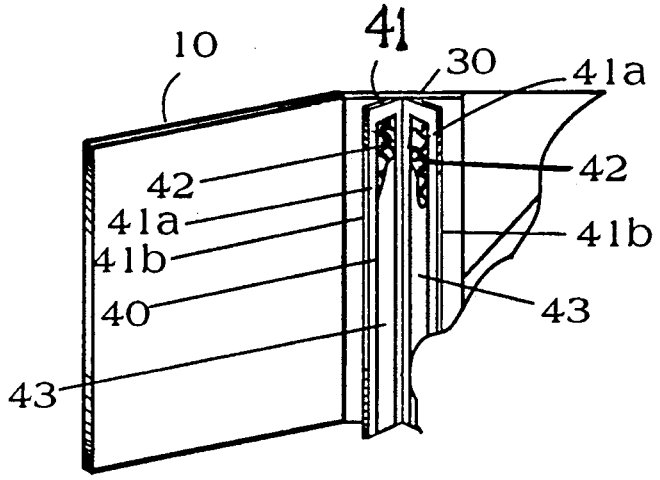
FIG. 3 is an enlarged fragmented front perspective view of the information binder as shown in FIG. 2.

In the enlarged fragmented front perspective view of the information binder 1 illustrated in FIG. 3 it can be seen that a page securing means 40 substantially comprises a V-shaped member 41 fixedly attached at its vertex to the spine portion 30 of the information binder 1. Sealing means 42, preferably a permanent, pressure sensitive adhesive, is disposed on the inside portion 41*a* of the respective legs 41*b* of the V-shaped member 41 for secure attachment of an information page 50 as hereinafter described in greater detail. A sealing means liner 43 is disposed on top of the sealing means 42 on each leg 41*b* to prevent premature engagement of the sealing means 42.

Figure 4:
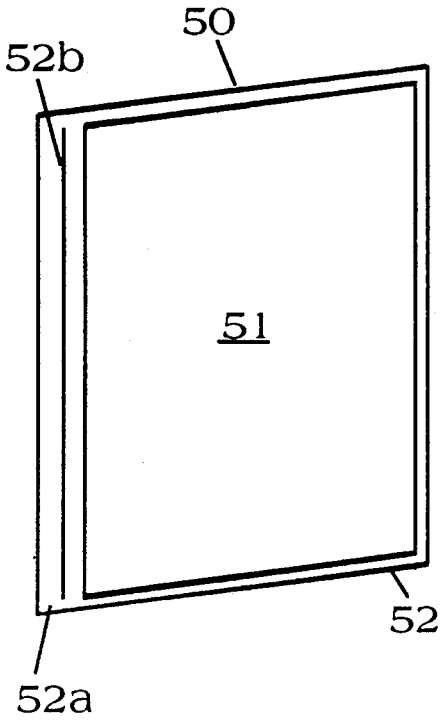
FIG. 4 is a perspective view of a first preferred embodiment of an information page suitable for use in the information binder of the present invention.

FIG. 4 illustrates a first preferred embodiment of an information page 50 suitable for use in the information binder 1 of the present invention. Information pages may have any construction that provides an enclosed body having a slot formed in one side only. The first preferred construction of an information page 50 comprises a stiffener 51 disposed within a transparent film body 52 having an outside portion and an inside portion. A securing means attachment portion 52*a* extends from one side of the transparent film body 52. A slot 52*b* is formed in the securing means attachment portion 52*a* of the film body 52. Slot 52*b* provides access to the inside portion of the transparent film body 52.

Figure 5:
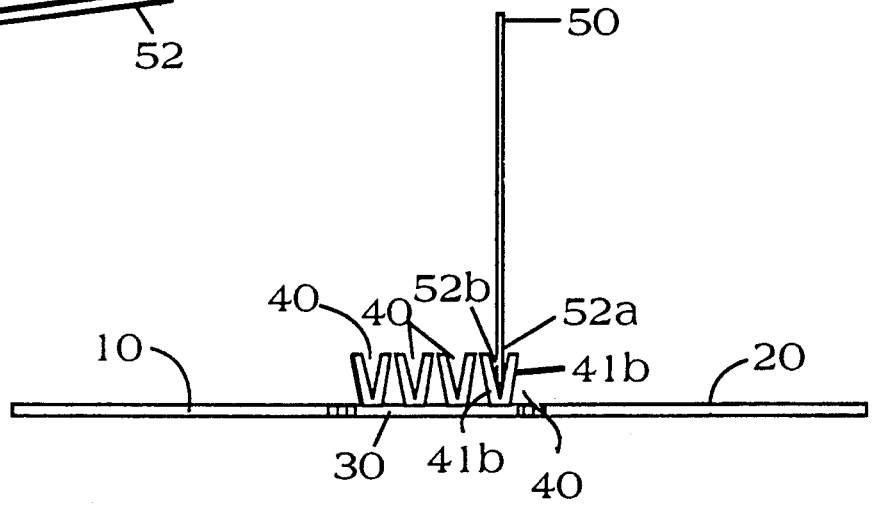
FIG. 5 is an end elevational view of the information binder shown with a single information page attached thereto.

The information binder 1 of the present invention is directed to secure means of attachment of information pages 50 in an expandable binder. Although original documents may be collected and stored in the present invention, it is intended primarily for storage of copies and duplicate forms of information. The information, for example a recent photograph and physical description of a child, is placed inside the film body 52 through the slot 52*b* formed in the securing means attachment portion 52*a*. As can be seen in the end elevational view of the information binder 1 illustrated in FIG. 5, the securing means attachment portion 52*a* is placed between the legs 41*b* of the V-shaped member 41 (the sealing means liners 43 being removed) and the slot 52*b* is enclosed and sealed between the legs 41*b* by pressing the legs 41*b* together along the length of the V-shaped member 41. This closure permits a secure and permanent engagement of the information page 50. It should be understood that portions of the sealing means 42 extend beyond the edges of the securing means attachment portion 52*a* when sealed. By providing a plurality of page securing means 40, supplemental information may be added to the information binder in the same manner without affecting the secure attachment of the first information page 50.

Figure 6:
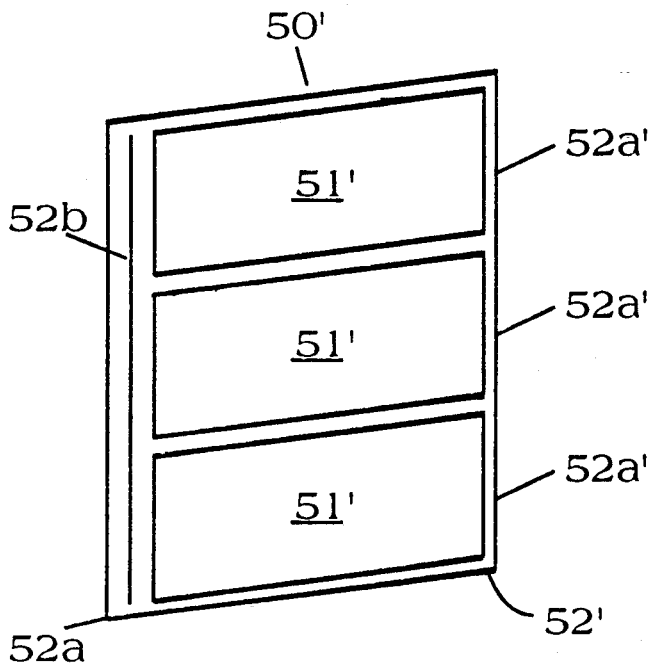
FIG. 6 is a perspective view of a second preferred embodiment of an information page suitable for use in the information binder of the present invention.

A second preferred embodiment of an information page 50' is illustrated in FIG. 6. Second information page 50' comprises a securing means attachment portion 52*a* and a transparent film body 52' having a plurality of pockets 52*a'* formed therein which communicate at one side only with a slot 52*b* formed in the securing means attachment portion 52*a*. Stiffeners 51' are disposed in the respective pockets 52*a'* of the film body 52'. Second information page 50' is secured to the page securing means 40 in the same manner as previously described.

Various changes and modifications may be made to the present invention without departing from its spirit and scope. Such changes and modifications within the appended claims are intended as part of the present disclosure.

Therefore in view of the foregoing, I claim:

1. An information binder comprising a top cover;

a bottom cover;

a rigid spine portion, said top cover and said bottom cover being hingedly attached to said spine portion;

at least one page securing means vertically-extending and fixedly attached to said spine portion between said top cover an said bottom cover, said page securing means comprising a V-shaped member fixedly attached at the vertex thereof to said spine portion and having permanent, pressure sensitive adhesive sealing means disposed on an inside portion of said V-shaped member; and at least one information page selectively attachable to said page securing means, said information page comprising a transparent film body having an outside portion, an inside portion, and a securing means attachment portion extending from one side of the film body, said securing means attachment portion having a slot formed therein which communicates with the inside portion of the film body and extends from a top portion of the securing means attachment portion to a bottom portion of the sealing means attachment portion, the transparent film body being attachable to said page securing means by sealingly engaging said securing means attachment portion and the slot formed therein to the inside portion of said V-shaped member to overlap the slot and permanently seal the transparent film body and any information stored in the transparent film body.

2. An information binder comprising a top cover;

a bottom cover;

a rigid spine portion, said top cover and said bottom cover being hingedly attached to said spine portion;

at least one page securing means vertically-extending and fixedly attached to said spine portion between said top cover and said bottom cover, said page securing means comprising a V-shaped member fixedly attached at the vertex thereof to said spine portion and having permanent, pressure sensitive adhesive sealing means disposed on an inside portion of said V-shaped member; and at least one information page selectively attachable to said page securing means, said information page comprising a transparent film body having a plurality of pockets formed therein having an inside portion, an outside portion, and a securing means attachment portion extending from one side of the film body, said securing means attachment portion having a slot formed therein which communicates with the inside portion of the respective pockets and extends from a top portion of the securing means attachment portion to a bottom portion of the sealing means attachment portion, the transparent film body being attachable to said page securing means by sealingly engaging said securing means attachment portion and the slot formed therein to the inside portion of said V-shaped member to overlap the slot and permanently seal the transparent film body and any information stored in the respective pockets.

3. An information binder comprising a top cover;

a bottom cover;

a rigid spine portion, said top cover and said bottom cover being hingedly attached to said spine portion;

at least one information page securing means vertically-extending and fixedly attached to said spine portion between said top cover and said bottom cover, said page securing means comprising a V-shaped member fixedly attached at the vertex thereof to said spine portion and having adhesive sealing means disposed on an inside portion of said V-shaped member, said V-shaped member providing single means to seal an opening in an information page and attach the information page to the page securing means; and at least one transparent information page selectively attachable to said page securing means, said information page having an opening for receipt of printed information therethrough to an inside portion of the information page.

4. An information binder as in claim 3 wherein said adhesive sealing means is a permanent, pressure sensitive adhesive.

* * * * *